US006335387B1

(12) United States Patent
Twardowska et al.

(10) Patent No.: US 6,335,387 B1
(45) Date of Patent: Jan. 1, 2002

(54) INSULATING SLEEVE COMPOSITIONS CONTAINING FINE SILICA AND THEIR USE

(75) Inventors: Helena Twardowska; Ronald C. Aufderheide, both of Dublin, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/531,360

(22) Filed: Mar. 21, 2000

(51) Int. Cl.[7] ..... C08J 9/32; B22C 1/22

(52) U.S. Cl. ..... 523/219; 521/54; 523/218; 164/527

(58) Field of Search ..... 521/54; 523/218, 523/219; 524/444, 493, 494

(56) References Cited

U.S. PATENT DOCUMENTS

| | | | | |
|---|---|---|---|---|
| 3,409,579 A | | 11/1968 | Robins | 260/30.4 |
| 4,240,496 A | | 12/1980 | El Gammal | 164/138 |
| 4,352,856 A | | 10/1982 | Smillie | 428/329 |
| 5,411,763 A | * | 5/1995 | Weaver et al. | 427/249 |
| 5,915,450 A | * | 6/1999 | Aufderheide et al. | 164/53 |
| 6,133,340 A | * | 10/2000 | Menon | 523/139 |

FOREIGN PATENT DOCUMENTS

| | | | |
|---|---|---|---|
| WO | WO 97/35677 | 10/1997 | B22C/9/08 |
| WO | WO 98/03284 | 1/1998 | B22D/7/10 |

* cited by examiner

*Primary Examiner*—Morion Fuelak
(74) *Attorney, Agent, or Firm*—David L. Hedden

(57) ABSTRACT

This invention relates to insulating sleeve compositions comprising (1) a major amount of hollow aluminosilicate microspheres, and (2) fine silica. The sleeve compositions are used to form sleeve mixes by mixing them with a chemically reactive binder. Sleeves are formed from the sleeve mix and are cured in the presence of a catalyst by the cold-box or no-bake cuing process. The invention also relates to a process for casting metal parts using a casting assembly where the sleeves are a component of the casting assembly. Additionally, the invention relates to the metal parts produced by the casting process.

7 Claims, No Drawings

INSULATING SLEEVE COMPOSITIONS CONTAINING FINE SILICA AND THEIR USE

FIELD OF THE INVENTION

This invention relates to insulating sleeve compositions comprising (1) a major mount of hollow aluminosilicate microspheres, and (2) fine silica The sleeve compositions are used to form sleeve mixes by mixing them with a chemically reactive binder. Sleeves are formed from the sleeve mix and are cured in the presence of a catalyst by the cold-box or no-bake curing process. The invention also relates to a process for casting metal parts using a casting assembly where the sleeves are a component of the casting assembly. Additionally, the invention relates to the metal parts produced by the casting process.

BACKGROUND OF THE INVENTION

A casting assembly consists of a pouring cup, a gating system (including downsprues, choke, and runner), risers, sleeves, molds, cores, and other components. To produce a metal casting, metal is poured into the pouring cup of the casting assembly and passes through the gating system to the mold and/or core assembly where it cools and solidifies. The metal part is then removed by separating it from the core and/or mold assembly.

Risers or feeders are reservoirs which contain excess molten metal which is needed to compensate for contractions or voids of metal which occur during the casting process. Metal from the riser fills such voids in the casting when metal from the casting contracts. Thus, the metal from the riser is allowed to remain in a liquid state for a longer period, thereby providing metal to the casting as it cools and solidifies. Sleeves are used to surround or encapsulate the riser and other parts of the casting assembly in order to keep the molten metal in the riser hot and maintain it in the liquid state. The temperature of the molten metal and the amount of time that the metal in the riser remains molten are a function of the sleeve composition and the thickness of the sleeve wall, among other factors.

Typical materials used to make sleeves are aluminum, oxidizing agents, fibers, fillers and refractory materials, particularly alumina, aluminosilicate, and aluminosilicate in the form of hollow aluminosilicate spheres. The type and amount of materials in the sleeve mix depends upon the properties of the sleeves that are to be made, particularly the insulating and exothermic properties of the sleeve.

Three basic processes are used for the production of sleeves, "ramming", "vacuuming", and "blowing or shooting". Ramming and blowing are methods of compacting a sleeve composition and binder into a sleeve shape. Ramming consists of packing a sleeve mix (sleeve composition and binder) into a sleeve pattern made of wood, plastic, and/or metal. Vacuuming consists of applying a vacuum to an aqueous slurry of a refractory and/or fibers and suctioning off excess water to form a sleeve. Typically, when vacuuming is used to form the sleeve, the sleeves formed are oven-dried to remove contained water and cure the sleeve. If the contained water is not removed, it may vaporize when it is exposed to the hot metal and result in a safety hazard.

These compositions are modified, in some cases, by the partial or complete replacement of the fibers with hollow aluminosilicate microspheres. See PCT publication WO 94/23865. This procedure makes it possible to vary the insulating properties of the sleeves and reduces or eliminates the use of fibers which can create health and safety problems to workers making the sleeves and using the sleeves in the casting process. WO 98/03284 discloses a cold-box and no-bake process for making sleeves with certain hollow aluminosilicate microspheres.

One property of sleeves that is of major concern is the safety margin of the sleeve. The safety margin is the distance from the top of the casting surface to the shrinkage cavity within the riser. A positive value indicates that all shrinkage was confined to the riser and the casting was sound. A negative value indicates that shrinkage extended into the casting. The safety margin can be measured in inches or as a percentage of the total height of the original riser. Generally, values that are more positive indicate better performance. There is a continuous interest in developing sleeves with an increased safety factor.

SUMMARY OF THE INVENTION

This invention relates to insulating sleeve compositions comprising:

(1) a major amount of hollow aluminosilicate microspheres, and (2) fine silica.

The sleeve compositions are used to form sleeve mixes by mixing them with a chemically reactive binder.

The sleeves are cured in the presence of a catalyst by the cold-box or no-bake curing process. The invention also relates to a process for casting metal parts using a casting assembly where the sleeves are a component of the casting assembly.

The addition of small amounts of fine silica to the sleeve composition improves the insulating properties and safety margin of insulating riser sleeves made from the sleeve compositions and an organic binder. The surface finish of castings, made with casting assemblies where the insulating sleeves are inserted, is also improved.

DEFINITIONS

The following definitions will be used for terms in the disclosure and claims:

Casting assembly—assembly of casting components such as pouring cup, downsprue, gating system (downsprue, runner, choke), molds, cores, risers, sleeves, etc. which are used to make a metal casting by pouring molten metal into the casting assembly where it flows to the mold assembly and cools to form a metal part.

Chemical binding—binding created by the chemical reaction of a catalyst and a binder which is mixed with a sleeve composition.

Cold-box—mold or core making process, which uses a vaporous catalyst to cure resins, used to make the mold or core.

ISOCURE® cold-box binder—a two part polyurethane-forming cold-box binder where the Part I is a phenolic resin similar to that described in U.S. Pat. No. 3,485,797. The resin is dissolved in a blend of aromatic, ester, and aliphatic solvents, and a silane. Part II is the polyisocyanate component, and comprises a polymethylene polyphenyl isocyanate, a solvent blend consisting primarily of aromatic solvents and a minor amount of aliphatic solvents, and a benchlife extender. The weight ratio of Part I to Part II is about 55:45.

Insulating sleeve—a sleeve having greater insulating properties than the mold/core assembly into which it is inserted. An insulating sleeve typically is contains low-density materials such as fibers and/or hollow microspheres.

Mold assembly—an assembly of molds and/or cores made from a foundry aggregate (typically sand) and a foundry binder, which is placed in a casting assembly to provide a shape for the casting.

No-bake—mold or core making process which uses a liquid catalyst to cure the mold or core, also known as cold-curing.

Riser—cavity connected to a mold or casing cavity of the casting assembly, which acts as a reservoir for excess molten metal to prevent cavities in the casting as it contacts on solidification. Risers may be open or blind. Risers are also known as feeders or heads.

Safety margin—distance from the top of the casting surface to the shrinkage cavity within the riser. A positive value indicates that all shrinkage was confined to the riser and the casing was sound. A negative value indicates that shrinkage extended into the casting. The safety margin can be measured in inches or as a percentage of the total height of the original riser. Generally, values that are more positive indicate better performance.

SGT—hollow aluminosilicate microspheres sold by PQ Corporation having a particle size of 10–350 microns and an alumina content between 28% to 33% by weight based upon the weight of the microspheres.

GT—hollow aluminosilicate microspheres sold by PQ Corporation having a particle size of 10–350 microns and an alumina content between 24% to 30% by weight based upon the weight of the microspheres.

SLG—hollow aluminosilicate microspheres sold by PQ Corporation having a particle size of 10–300 microns and an alumina content of about 40% by weight based upon the weight of the microspheres.

Sleeve—any moldable shape having exothermic and/or insulating properties made from a sleeve composition which covers, in whole or part, any component of the casting assembly such as the riser, runners, pouring cup, sprue, etc. or is used as part of the casting assembly. Sleeves can have a variety of shapes, e.g. cylinders, domes, cups, boards, cores.

Sleeve composition—any composition that is capable of providing a sleeve with exothermic and/or insulating properties. Sleeve mix—a mixture comprising a sleeve composition and a chemical binder.

US Standard Screen Test—test to determine particle size distribution using set of sieves 8" diameter and aperture sizes from 4 inches to 500 mesh.

DESCRIPTION OF BEST MODE AND OTHER MODES FOR PRACTICING THE INVENTION

The insulating sleeve composition comprises a major amount of hollow alurminosilicate microspheres and a minor amount of a source of "fine silica". Fine silica is defined as silica, typically a powder, having a particle distribution such that 95 weight percent of the silica passes through a 100 mesh as determined by the US Standard Screen Test, preferably a particle distribution such that more than 95 percent of the silica passes through a 200 mesh. Sources of fine silica include silica flour (100 mesh and finer), diatomaceous earth, and precipitated silica. In addition, materials high in silica, such as Pyrex can be used. The best sources of fine silica are low-density materials, e.g. diatomaceous earth or precipitated silica Unfortunately, fine silica tends to absorb a large amount of binder, which lowers the physical strength of the sleeve. Therefore, only minor amounts of fine silica are effectively used in the sleeve composition, typically from 1 to 5 weight percent based on the weight of the hollow aluminum microspheres and fine silica, preferably no more than about 20 weight percent, most preferably less than about 10 weight percent.

Examples of hollow aluminosilicate microspheres that can be used in the sleeve composition are disclosed in WO 97/35677, which is hereby incorporated by reference.

The thermal conductivity of the hollow aluminosilicate microspheres ranges from about 0.05 W/m.K to about 0.6 W/m.K at room temperature, more typically from about 0.1 W/m.K to about 0.5 W/m.K.

The sleeves made with aluminosilicate hollow microspheres have low densities, low thermal conductivities, and excellent insulating properties. The insulating properties of the sleeve can be varied by varying the amount of hollow aluminosilicate microspheres, but have thermal properties which are different in degree and/or kind than the mold assembly into which they will be inserted Typically, the amount of hollow aluminosilicate microspheres in the sleeve composition will range from 50 weight percent to 99 weight percent, preferably from 80 weight percent to 95 weight percent, based upon the weight of the sleeve composition.

The hollow aluminosilicate microspheres typically have a particle size of about 3 mm. with any wall thickness. Preferred are hollow aluminosilicate microspheres having an average diameter less than 1 mm and a wall thickness of approximately 10% of the particle size. It is believed that hollow microspheres made of material other than aluminosilicate, having insulating properties, can also be used to replace or used in combination with the hollow aluminosilicate microspheres.

The weight percent of alumina to silica (as $SiO_2$) in the hollow aluminosilicate microspheres can vary over wide ranges depending on the application, for instance from 25:75 to 75:25, typically 33:67 to 50:50, where said weight percent is based upon the total weight of the hollow microspheres. It is known from the literature that hollow aluminosilicate microspheres having a higher alumina content are better for making sleeves used in pouring metals such as iron and steel which have casting temperatures of 1300° C. to 1700° C. because hollow aluminosilicate microspheres having more alumina have higher melting points. Thus, sleeves made with these hollow aluminosilicate microspheres will not degrade as easily at higher temperatures.

Refractories, although not necessarily preferred in terms of performance because of their higher densities and high thermal conductivities, may be used in the sleeve compositions to impart higher melting points to the sleeve mixture so the sleeve will not degrade when it comes into contact with the molten metal during the casting process. Examples of such refractories include silica, magnesia, alumina, olivine, chromite, other forms of aluminosilicate, and silicon carbide among others. These refractories are preferably used in amounts less than 25 weight percent based upon the weight of the sleeve composition, more preferably less than 10 weight percent based upon the weight of the sleeve composition.

The density of the sleeve composition typically ranges from about 0.1 g/cc to about 0.7 g/cc, more typically from about 0.3 g/cc to about 0.6 g/cc. In addition, the sleeve composition may contain fillers and additives, such as cellulose fibers, wood flour, and ceramic fibers.

The sleeve compositions are mixed with chemical binders to form a sleeve mix. Any inorganic or organic foundry binder, that sufficiently holds the sleeve mix together in the shape of a sleeve and polymerizes in the presence of a curing catalyst, will work. Examples of such binders include inorganic binders such as sodium silicate binders cured with carbon dioxide (see U.S. Pat. No. 4,985,489 which is hereby incorporated into this disclosure by reference), and organic binders such as phenolic resins, phenolic urethane binders, furan binders, alkaline phenolic resole binders (see U.S. Pat. No. 4,750,716 which is hereby incorporated by reference), and epoxy-acrylic binders among others. Preferred binders include epoxy-acrylic binders sold by Ashland Inc. under the ISOSET® trademark. The epoxy-acrylic binders, cured with sulfur dioxide in the presence of an oxidizing agent, are described in U.S. Pat. No. 4,526,219, which is hereby incorporated into this disclosure by reference. Most preferred as the binder are amine curable phenolic urethane binders, are described in U.S. Pat. No. 3,485,497, U.S. Pat. Nos. 3,409,579, and 3,676,3923, which are hereby incorporated into this disclosure by reference. These binders are based on a two-part system, one part being a phenolic resin component and the other part being a polyisocyanate component.

The amount of binder needed is an effective amount to maintain the shape of the sleeve and allow for effective curing, i.e. which will produce a sleeve which can be handled or self-supported after curing. An effective amount of binder is greater than about 4 weight percent, based upon the weight of the sleeve composition. Preferably, the amount of binder ranges from about 5 weight percent to about 15 weight percent, more preferably from about 6 weight percent to about 12 weight percent.

Curing the sleeve by the no-bake process takes place by mixing a liquid curing catalyst with the sleeve mix, shaping the sleeve mix containing the catalyst, and allowing the sleeve shape to cure, typically at ambient temperature without the addition of heat. The preferred liquid curing catalyst is a tertiary amine and the preferred no-bake curing process is described in U.S. Pat. No. 3,485,797, which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyrdine, quinoline, N-methyl imidazole, N-ethyl imidazole, 4,4'-dipyridine, 4-phenylpropylpyridine, 1-methylbenzimidazole, and 1,4-thiazine.

Curing the sleeve by the cold-box process takes place by blowing or ramming the sleeve mix into a pattern and contacting the sleeve with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins. Sulfur dioxide (in conjunction with an oxidizing agent) is used with an epoxy-acrylic resin. Carbon dioxide (see U.S. Pat. No. 4,985,489, which is hereby incorporated by reference) or methyl esters (see U.S. Pat. No. 4,750,716 which is hereby incorporated into this disclosure by reference) are used with alkaline phenolic resole resins.

Preferably sleeves are prepared by a cold-box process with a phenolic urethane binder by passing a tertiary amine gas, such a triethylamine, through the molded sleeve mix in the manner as described in U.S. Pat. No. 3,409,579; with an epoxy-acrylic binder cured with sulfur dioxide by a free radical mechanism in the presence of an oxidizing agent as described in U.S. Pat. No. 4,526,219; or with an epoxy-acrylic-polyisocyanate binder cured with a tertiary amine gas and by a free radical mechanism as described in U.S. Pat. No. 5,880,175, which is hereby incorporated by reference. Typical gassing times are from 0.5 to 3.0 seconds, preferably from 0.5 to 2.0 seconds. Purge times are from 1.0 to 60 seconds, preferably from 1.0 to 10 seconds.

EXAMPLES

All lettered Examples are controls that use formulations without fine silica. All parts are by weight and all percentages are weight percentages based upon the weight of the sleeve composition unless otherwise specified. The examples merely illustrate the invention and are not intended to limit its scope.

Insulating sleeves were prepared using cold-box technology with a phenolic-urethane binder by mixing the sleeve compositions described in Table I and the binder in a Hobart N-50 mixer for about 24 minutes. Sleeve formulations using microspheres with and without the silica additive were mixed with an ISOCURE® Part I and Part II binder and then cured with triethylamine catalyst (TEA) using conventional cold box technology. The amount of binder used in all cases was 8.8 weight percent based upon the weight of the sleeve composition. The sleeves were then tested for casting performance in both steel and ductile iron in the Melt Lab. Insertable style 2"×3"×"⅜" (diameter/height/thickness) is risers were used on top of a 3" cube casting for steel and on top of an impeller test casting for ductile iron.

Evaluation of castings included measuring the safety margin of the riser and performing a visual analysis of the surface finish of the casting. The safety margin is expressed as the distance between the shrinkage cavity and the interface between the riser and the surface of the casting, in inches. Several formulations were tested, using different microspheres and silica materials. In Example B, GT microspheres were used instead of SGT. They have lower softening point because of lower content of alumina. Their softening point is about 1000C, comparing to 1200C of SGT microspheres. The results are summarized in the Table below.

TABLE I

SAFETY MARGIN WITH DIFFERENT INSULATING SLEEVE COMPOSITIONS (USING 2" × 3" INSERTABLE SLEEVE, HAVING ⅜" THICKNESS AND 3") TO MAKE CUBE STEEL AND IMPELLER DUCTILE IRON TEST CASTINGS

| | SLEEVE COMPOSITION | | | SAFETY MARGIN | SAFETY MARGIN DUCTILE IRON | | SURFACE |
|---|---|---|---|---|---|---|---|
| EXAMPLE | SLG | SGT/GT | SF | STEEL | PSM[1] | SSM[2] | FINISH |
| A | 60 | 40 | 0 | 0.2 | 1.53 | −1.60 | Acceptable |
| 1 | 57 | 38 | 5 | 0.45 | 1.78 | 0.70 | Improved |

TABLE I-continued

SAFETY MARGIN WITH DIFFERENT INSULATING SLEEVE COMPOSITIONS (USING 2" × 3" INSERTABLE SLEEVE, HAVING ⅜" THICKNESS AND 3") TO MAKE CUBE STEEL AND IMPELLER DUCTILE IRON TEST CASTINGS

| | SLEEVE COMPOSITION | | | SAFETY MARGIN | SAFETY MARGIN DUCTILE IRON | | SURFACE |
|---|---|---|---|---|---|---|---|
| EXAMPLE | SLG | SGT/GT | SF | STEEL | PSM[1] | SSM[2] | FINISH |
| B | 60 | 40 | 0 | 0.68 | 1.27 | 0.9 | Poor |
| 2 | 57 | 38 | 5 | 1.3 | 1.44 | 1.14 | Improved |

[1]Primary safety margin.
[2]Secondary safety margin.

These results in Table I indicate that the safety margin of the riser sleeve is significantly increased by the addition of silica flour to the insulating sleeve composition. In addition, the surface finish was somewhat better with the addition of silica. The GT microspheres give higher safety margin than SGT's, but poor surface finish because of their low softening point. Use of small amount of silica allows results in both good safety margin and acceptable surface finish with all microspheres.

What is claimed is:

1. An insulating sleeve composition comprising:

(A) a major amount of hollow aluminosilicate microspheres, (B) an effective amount of fine silica, and (C) an effective amount of a chemically reactive polymeric binder, where said amounts are based upon the amount of the total sleeve composition an effective amount of a chemically reactive polymeric binder.

2. The sleeve composition of claim 1 wherein the amount of hollow aluminosilicate microspheres in the sleeve composition is from 50 weight percent to 99 weight percent based upon the weight of the sleeve composition.

3. The sleeve composition of claim 2 wherein the amount of fine silica in the sleeve mix is no more than 10 weight percent based upon the weight of (A) and (B).

4. The sleeve composition of claim 3 wherein the amount of hollow aluminosilicate microspheres in the sleeve composition is from 80 weight percent to 95 weight percent based upon the weight of (A) and (B).

5. The sleeve composition of claim 4 wherein the weight percent of alumina to silica (as $SiO_2$) in the hollow aluminosilicate microspheres is from 25:75 to 75:25, and said weight percent is based upon the total weight of the hollow microspheres.

6. The insulating sleeve mix of claim 1 wherein the binder is selected from the group consisting of phenolic urethane binders and epoxy-acrylic binders.

7. The insulating sleeve mix of claim 1 wherein the binder level is from about 4 weight percent to about 12 weight percent based upon the weight of the sleeve composition.

* * * * *

UNITED STATES PATENT AND TRADEMARK OFFICE

CERTIFICATE OF CORRECTION

PATENT NO. : 6,335,387 B1 
DATED : January 1, 2002
INVENTOR(S) : Helena Twardowska and Ronald C. Aufderheide It is certified that error appears in the above-identified patent and that said Letters Patent is hereby corrected as shown below:

Column 7,
Lines 34-35, delete "an effective amount of a chemically reactive polymeric binder".

Signed and Sealed this

Twenty-seventh Day of May, 2003

JAMES E. ROGAN
*Director of the United States Patent and Trademark Office*